US007952043B2

(12) United States Patent
Lin

(10) Patent No.: US 7,952,043 B2
(45) Date of Patent: May 31, 2011

(54) KEYBOARD WITH BACKLIGHTING FUNCTIONALITY

(75) Inventor: Jyh-Tsong Lin, Taipei (TW)

(73) Assignee: Changshu Sunrex Technology Co., Ltd., Changshu (CN)

( * ) Notice: Subject to any disclaimer, the term of this patent is extended or adjusted under 35 U.S.C. 154(b) by 405 days.

(21) Appl. No.: 12/332,963

(22) Filed: Dec. 11, 2008

(65) Prior Publication Data

US 2010/0147660 A1 Jun. 17, 2010

(51) Int. Cl.
*H01H 9/00* (2006.01)

(52) U.S. Cl. ..... 200/310

(58) Field of Classification Search ..... 200/310–314, 200/5 A, 512, 517, 344–345; 362/555, 558, 362/559, 616, 26, 27
See application file for complete search history.

(56) References Cited

U.S. PATENT DOCUMENTS

| | | | | |
|---|---|---|---|---|
| 7,057,125 | B1 * | 6/2006 | Tsai | 200/310 |
| 7,503,683 | B2 * | 3/2009 | Liu | 362/616 |
| 7,534,001 | B2 * | 5/2009 | Liu | 362/24 |
| 2004/0257829 | A1 * | 12/2004 | Suwa et al. | 362/555 |

* cited by examiner

*Primary Examiner* — Edwin A. Leon
(74) *Attorney, Agent, or Firm* — Harry K. Ahn; Abelman Frayne & Schwab

(57) ABSTRACT

A keyboard with backlighting functionality includes: a membrane circuit substrate having an upper circuit sheet, an insulator sheet, and a lower circuit sheet laminated together in sequence; a press key set having a plurality of press keys that are disposed on the membrane circuit substrate, and that are capable of being pressed so as to cause the membrane circuit substrate to transmit input signals; and at least one light-emitting element mounted onto a lower surface of the upper circuit sheet that faces the insulator sheet. The membrane circuit substrate is configured as a backlighting sheet that allows light from the light-emitting element to propagate therein, and is formed with a plurality of reflecting dots for directing the light that propagates in the membrane circuit substrate toward the press keys of the press key set.

9 Claims, 4 Drawing Sheets

KEYBOARD WITH BACKLIGHTING FUNCTIONALITY

BACKGROUND OF THE INVENTION

1. Field of the Invention

This invention relates to a keyboard for an input device, more particular to a keyboard with backlighting functionality that can be used in a notebook computer, a mobile phone, and the like.

2. Description of the Related Art

In order to use a notebook computer or a mobile phone at night or in a dark place, keyboards with backlighting functionality are commonly utilized. Such keyboards with backlighting functionality are disclosed in, for example, Taiwan patent Nos. 226621 and 223751, and Taiwan utility model Nos. M306689 and M330513.

A keyboard with backlighting functionality is a keyboard illuminated by a backlighting sheet. Usually, the backlighting sheet is a plate that allows light from light-emitting elements to propagate therein.

For example, a conventional keyboard with backlighting functionality disclosed in Taiwan patent no. M330513 comprises: a light-transmissive membrane circuit substrate; a keyboard base for supporting on underside of the membrane circuit substrate; a press key set having a plurality of press keys that are disposed on the membrane circuit substrate and that are capable of being pressed so as to cause the membrane circuit substrate to transmit input signals; a plurality of light-emitting elements disposed at one side of the membrane circuit substrate; and a light-guiding plate disposed under the keyboard base. The light-guiding plate has a backlighting sheet which allows light from the light-emitting elements to diffuse and to propagate therein, and a reflecting plate which is fixed under the backlighting sheet, and which is capable of reflecting light that exits from the backlighting sheet back thereto.

Since the top of each press key is made of a light-transmissive material, and since positions on the keyboard base corresponding to the press keys are also light-transmissible, the keyboard is capable of being illuminated by the light-guiding plate via the light-transmissive portions on the keyboard base and the top of each press key.

However, such a light-guiding plate, especially a backlighting sheet with a reflecting plate, would undesirably increase the overall thickness of the keyboard. Thus, a keyboard with such light-guiding plate cannot meet the current trend towards minimizing thickness.

Furthermore, in the prior art example, even if the conventional keyboard with backlighting functionality includes the reflecting plate, the light diffused in the light-guiding plate will be indiscriminately reflected toward the press keys by the reflecting plate based on the incident angle of the light. Apparently, the light is not concentrated but is reflected toward a broad range of the press keys, and thus, a larger number of the light-emitting elements becomes necessary. Particularly, when the keyboard is produced in a larger size, it is necessary to dispose more light-emitting elements in the keyboard, and thus, the manufacturing cost is accordingly increased. Besides, in the conventional keyboard with backlighting functionality, the brightness of the tops of the press keys depends on the distance between the press keys and the light-emitting elements, and thus, the tops of the press keys are likely to have a weakened brightness if their distances from the light-emitting elements are relatively far.

SUMMARY OF THE INVENTION

Therefore, in order to solve the problems mentioned above, an object of the present invention is to provide a keyboard with backlighting functionality that eliminates the need for an additional backlighting sheet or light-guiding plate, and that can concentrate emitted light on each of the press keys.

Accordingly, the keyboard with backlighting functionality of the present invention comprises: a membrane circuit substrate including an upper circuit sheet, an insulator sheet, and a lower circuit sheet laminated together in sequence; a press key set having a plurality of press keys that are disposed on the membrane circuit substrate, and that are capable of being pressed so as to cause the membrane circuit substrate to transmit input signals; and at least one light-emitting element mounted onto a lower surface of the upper circuit sheet that faces the insulator sheet. The membrane circuit substrate is configured as a backlighting sheet that allows light from the light-emitting element to propagate therein, and is formed with a plurality of reflecting dots for directing the light that propagates in the membrane circuit substrate toward the press keys of the press key set.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
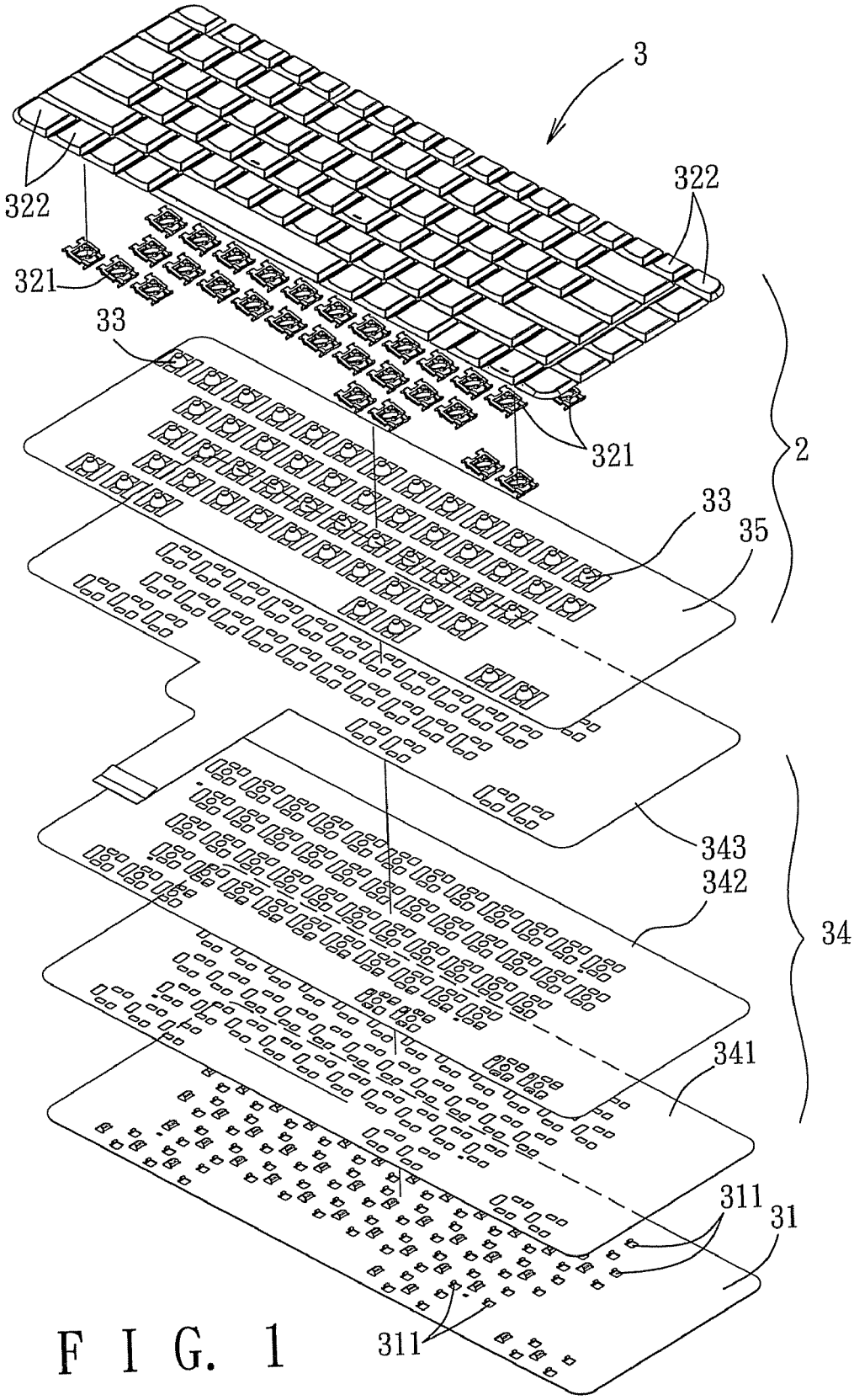
FIG. 1 is an exploded perspective view of the preferred embodiment of a keyboard with backlighting functionality according to the present invention.
Figure 2:
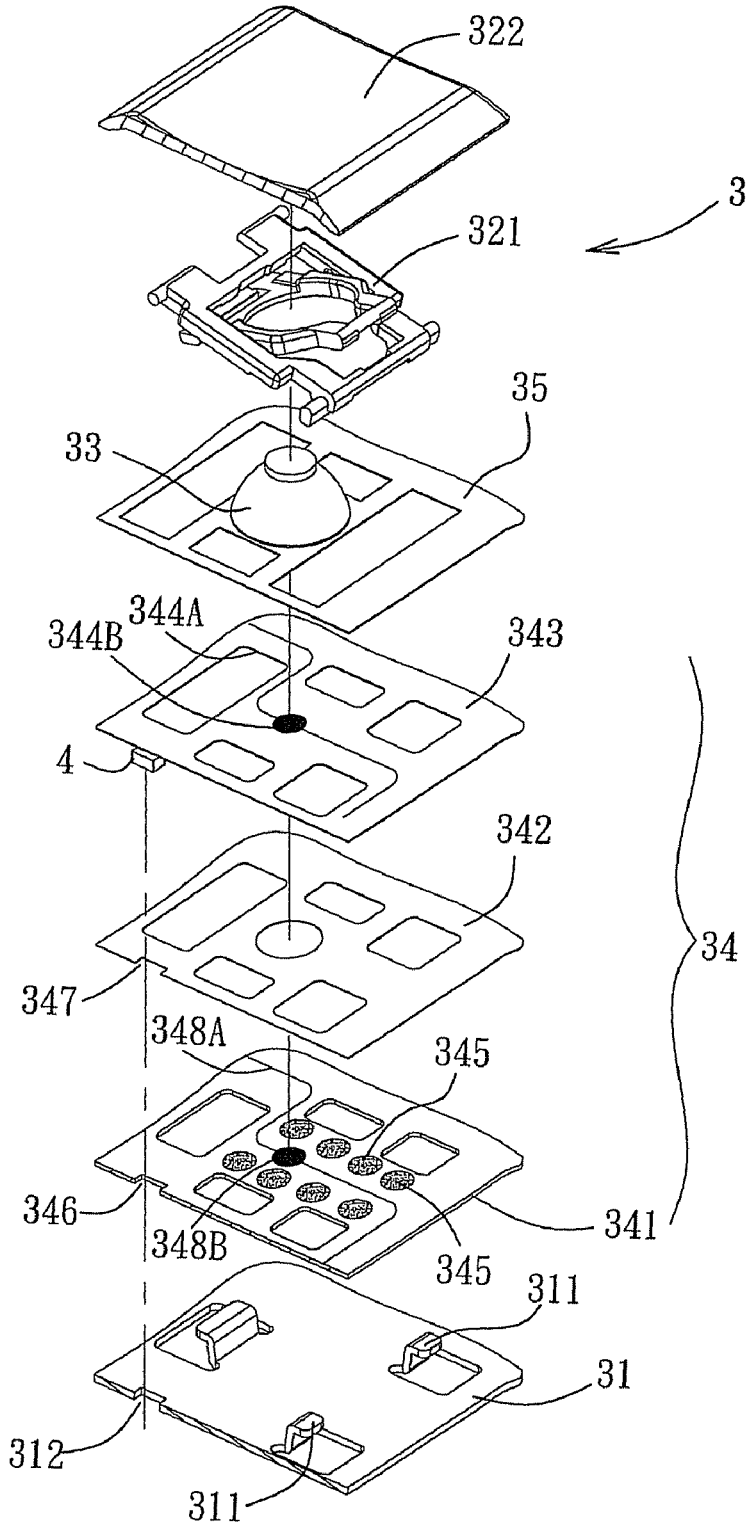
FIG. 2 is a fragmentary exploded perspective view of the preferred embodiment.
Figure 3:
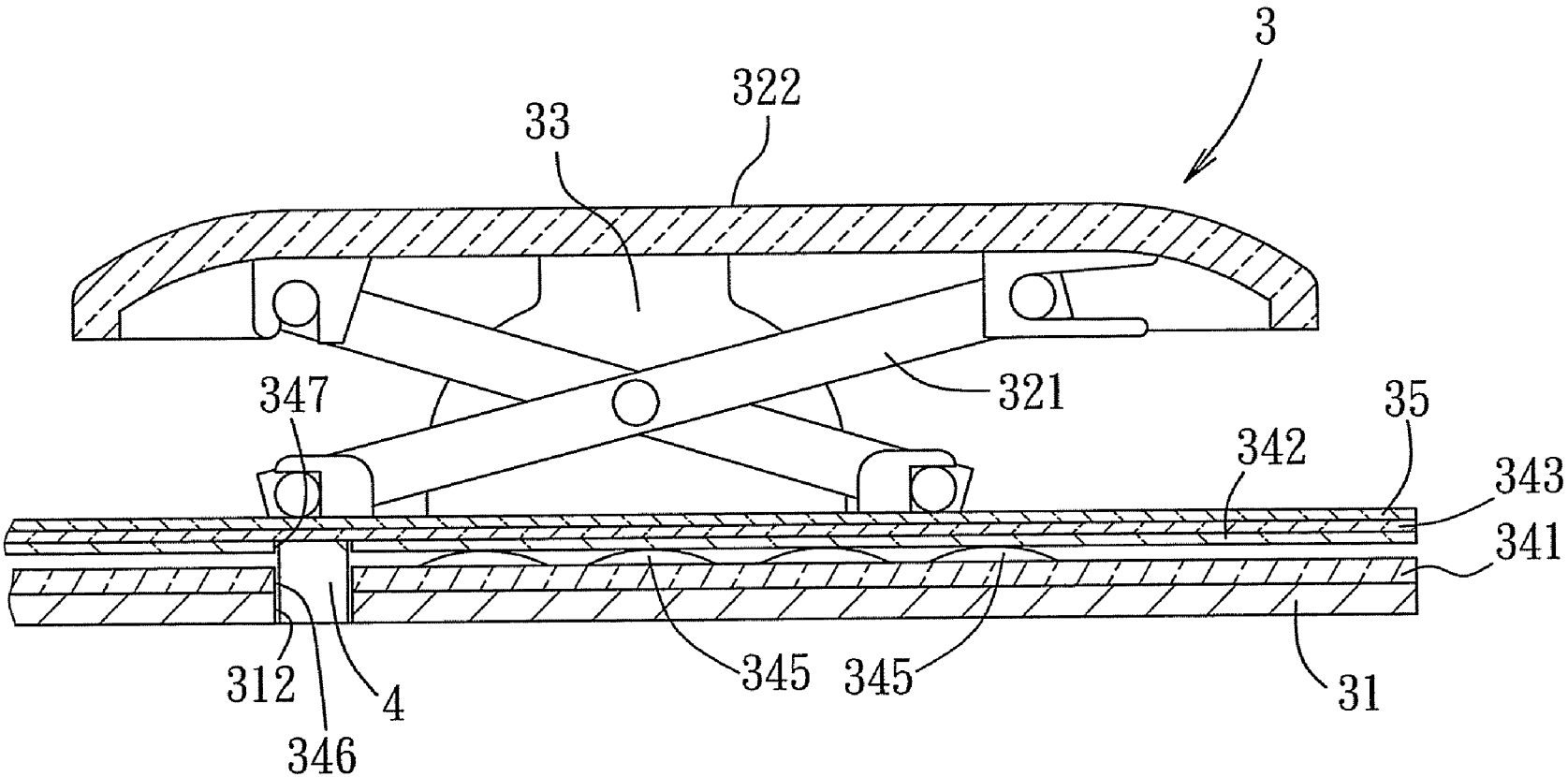
FIG. 3 is a fragmentary cross-sectional view of the preferred embodiment in an assembled state.
Figure 4:
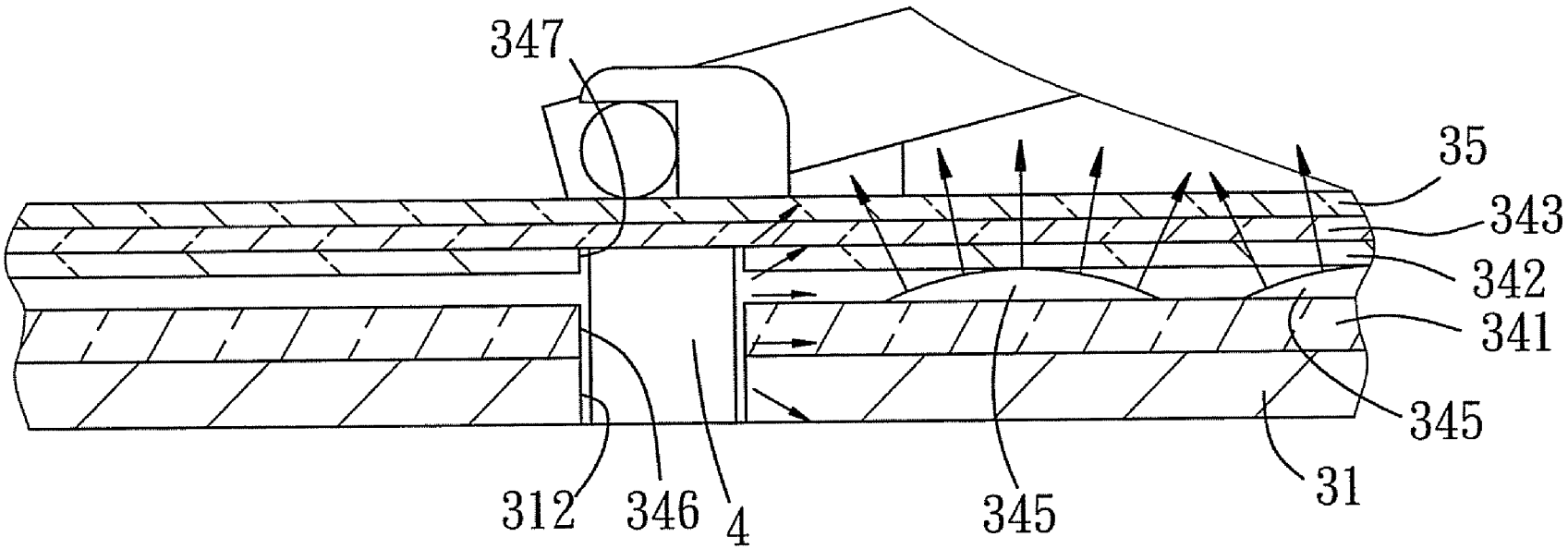
FIG. 4 is a fragmentary enlarged view of FIG. 3.

Referring to FIG. 1, the preferred embodiment of the keyboard with backlighting functionality according to the present invention is shown to include: a membrane circuit substrate 34 having a rectangular shape with four corners, a press key set 2 having a plurality of press keys 3, and four light-emitting elements 4 (only one is shown in FIGS. 2 to 4). The press keys 3 are disposed on the membrane circuit substrate 34, and are capable of being pressed so as to cause the membrane circuit substrate 34 to transmit input signals. The four light-emitting elements 4 are respectively disposed on the four corners of the membrane circuit substrate 34.

Each of the press keys 3 of the press key set 2, as shown in FIG. 2, includes: a keycap 322 that functions as a contact point for pressing by users; an X-shaped link-lever 321 for supporting the keycap 322, such that the keycap 322 is movable upwardly and downwardly; and a hollow elastic element 33 that biases the keycap 322 upwardly. Furthermore, the press key set 2 includes an elastic sheet 35 connected to all of the elastic elements 33 in the press key set 2.

The keycaps 322 are made of a light-transmissive material. The elastic elements 33 and the elastic sheet 35 can be made of a material commonly used in the conventional keyboard with backlighting functionality, such as rubber. In addition, each of the elastic elements 33 is formed with a protrusion (not shown) therein.

The membrane circuit substrate 34 is a flexible printed circuit substrate (FPC), and includes an upper circuit sheet 343, an insulator sheet 342, and a lower circuit sheet 341 laminated together in sequence. On a lower surface of the upper circuit sheet 343, a plurality of upper circuit traces 344A and a plurality of contact points 344B are formed. Similarly, on an upper surface of the lower circuit sheet 341, a plurality of lower circuit traces 348A and a plurality of contact points 348B are formed. When any of the keycaps 322 is pressed, the protrusion (not shown) in the corresponding elastic element 33 moves to bring the corresponding contact point 344B of the upper circuit sheet 343 into an electrically connected state with the corresponding contact point 348B of the lower circuit sheet 341, such that an input signal is transmitted by virtue of the electrical connection between the upper circuit traces 344A and the lower circuit traces 348B.

In the preferred embodiment, the upper circuit sheet 343, the insulator sheet 342, and the lower circuit sheet 341 are independently made of a light-guiding material selected from polycarbonate and polymethyl methacrylate, such that the membrane circuit substrate 34 is configured as a backlighting sheet that allows light from the light-emitting elements 4 to propagate therein.

Moreover, the membrane circuit substrate 34 is formed with an internal structure in the form of a plurality of reflecting dots 345 therein for directing the light that propagates in the membrane circuit substrate 34 toward the press keys 3 of the press key set 2. Therefore, the functionality of the membrane circuit substrate 34 as a backlighting sheet can be enhanced. In the preferred embodiment, the reflecting dots 345 are disposed on an upper surface of the lower circuit sheet 341 that faces the insulator sheet 342. Preferably, the reflecting dots 345 are respectively disposed on the upper surface of the lower circuit sheet 341 at positions corresponding to the press keys 3. Additionally, the reflecting dots 345 are formed from light-reflecting ink that has components such as $SiO_2$, $TiO_2$, etc., and are all dome-shaped.

Therefore, the membrane circuit substrate 34 of the keyboard with backlighting functionality according to the present invention not only functions as a backlighting sheet, but is also able to reflect light when the keyboard is in a use state. In detail, when the light that propagates in the membrane circuit substrate 34 hits the reflecting dots 345, the light would not be reflected indiscriminately but would be reflected in substantially the same direction toward the corresponding press keys 3 by virtue of the dome-shaped reflecting dots 345. Thus, the reflected light is more concentrated, and the functionality of the membrane circuit substrate 34 as a backlighting sheet can be further enhanced compared to the prior art.

Furthermore, as shown in FIGS. 1 and 2, a keyboard base 31 is disposed on a lower surface of the lower circuit sheet 341 that is opposite to the insulator sheet 342, and the keyboard base 31 is formed from a metal sheet. Accordingly, the keyboard base 31 is capable of reflecting light that exits from the lower surface of the lower circuit sheet 341 back into the membrane circuit substrate 34. A plurality of fastener parts 311 are formed on the keyboard base 31 by punching for fastening the membrane circuit substrate 34 and the press key set 2 together.

Moreover, each of the light-emitting elements 4 is mounted onto a lower surface of the upper circuit sheet 343 that faces the insulator sheet 342, and penetrates a respective through hole 347 in the insulator sheet 342, a respective through hole 346 in the lower circuit sheet 341, and a respective through hole 312 in the keyboard base 31. In the preferred embodiment, the light-emitting elements 4 are light-emitting diodes. Thus, the light-emitting elements 4 are electrically connected to the upper circuit sheet 343 and are not required to be electrically connected to an additional flexible circuit substrate.

Although the keyboard of the preferred embodiment comprises four of the light-emitting elements 4, it should be noted that the numbers and the positions of the light-emitting elements 4 are not intended to be limited to those of the preferred embodiment. For example, the light-emitting elements 4 can be disposed on four sides of the membrane circuit substrate 34 or other appropriate positions.

By configuring the membrane circuit substrate 34 as a backlighting sheet, there is no need for the keyboard according to the present invention to be provided with an additional light-guiding plate therein. In addition, the reflecting dots 345 formed inside the membrane circuit substrate 34 can further direct the light that propagates inside the membrane circuit substrate 34 toward the press keys 3 of the press key set 2. As such, in the present invention, the number of the light-emitting elements 4 and the overall thickness of the keyboard can be minimized, and the aforesaid drawbacks associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A keyboard with backlighting functionality, comprising:

a membrane circuit substrate including an upper circuit sheet, an insulator sheet, and a lower circuit sheet laminated together in sequence;

a press key set having a plurality of press keys that are disposed on said membrane circuit substrate, and that are capable of being pressed so as to cause said membrane circuit substrate to transmit input signals; and at least one light-emitting element mounted onto a lower surface of said upper circuit sheet that faces said insulator sheet;

wherein said membrane circuit substrate is configured as a backlighting sheet that allows light from said light-emitting element to propagate therein, and is formed with a plurality of reflecting dots for directing the light that propagates in said membrane circuit substrate toward said press keys of said press key set.

2. The keyboard of claim 1, wherein said reflecting dots are disposed on an upper surface of said lower circuit sheet that faces said insulator sheet.

3. The keyboard of claim 2, wherein said reflecting dots are dome-shaped, and are respectively disposed on said upper surface of said lower circuit sheet at positions corresponding to said press keys.

4. The keyboard of claim 3, further comprising a keyboard base disposed on a lower surface of said lower circuit sheet that is opposite to said insulator sheet, said keyboard base being formed from a metal sheet and being capable of reflecting light that exits from said lower surface of said lower circuit sheet back into said membrane circuit substrate.

5. The keyboard of claim 4, wherein said light-emitting element is mounted to penetrate said insulator sheet, said lower circuit sheet, and said keyboard base.

6. The keyboard of claim 1, wherein said light-emitting element is a light-emitting diode.

7. The keyboard of claim 1, wherein said reflecting dots are formed from light-reflecting ink.

8. The keyboard of claim 1, wherein said upper circuit sheet, said lower circuit sheet and said insulator sheet are independently made of a material selected from polycarbonate and polymethyl methacrylate.

9. The keyboard of claim 1, wherein said membrane circuit substrate has a rectangular shape with four corners, and said keyboard comprises four of said light-emitting elements respectively disposed on said four corners of said membrane circuit substrate.

* * * * *